US007273423B2

(12) United States Patent
Imamoto

(10) Patent No.: US 7,273,423 B2
(45) Date of Patent: Sep. 25, 2007

(54) GOLF CLUB HEAD

(75) Inventor: Yasunori Imamoto, Tokyo (JP)

(73) Assignee: Bridgestone Sport Corporation, Tokyo (JP)

( * ) Notice: Subject to any disclaimer, the term of this patent is extended or adjusted under 35 U.S.C. 154(b) by 229 days.

(21) Appl. No.: 11/001,046

(22) Filed: Dec. 2, 2004

(65) Prior Publication Data

US 2005/0148405 A1 Jul. 7, 2005

(30) Foreign Application Priority Data

Dec. 5, 2003 (JP) ..... P2003-407637

(51) Int. Cl.
*A63B 53/04* (2006.01)

(52) U.S. Cl. ..... 473/332; 473/345; 473/350; 473/346

(58) Field of Classification Search ..... 473/324–350
See application file for complete search history.

(56) References Cited

U.S. PATENT DOCUMENTS

| | | | | |
|---|---|---|---|---|
| 4,313,607 | A | 2/1982 | Thompson | |
| 4,319,752 | A | 3/1982 | Thompson | |
| 4,429,879 | A | 2/1984 | Schmidt | |
| 4,438,931 | A | 3/1984 | Motomiya | |
| 4,602,787 | A | 7/1986 | Sugioka et al. | |
| 5,316,305 | A | 5/1994 | McCabe | |
| 5,941,782 | A * | 8/1999 | Cook | 473/346 |
| 6,254,494 | B1 | 7/2001 | Hasebe et al. | |
| 6,340,337 | B2 | 1/2002 | Hasebe et al. | |
| 6,595,871 | B2 * | 7/2003 | Sano | 473/342 |
| 6,773,360 | B2 * | 8/2004 | Willett et al. | 473/334 |
| 6,783,465 | B2 * | 8/2004 | Matsunaga | 473/329 |

FOREIGN PATENT DOCUMENTS

| | | | |
|---|---|---|---|
| JP | 2-88677 | A | 3/1990 |
| JP | 2001-104520 | A | 4/2001 |
| JP | 2001-129130 | A | 5/2001 |
| JP | 2001-212272 | A | 8/2001 |
| JP | 2001-353240 | A | 12/2001 |
| JP | 2003-88601 | A | 3/2003 |

* cited by examiner

*Primary Examiner*—Eugene Kim
*Assistant Examiner*—Alvin A Hunter
(74) *Attorney, Agent, or Firm*—Sughrue Mion Pllc.

(57) ABSTRACT

To provide a golf club head in which a sole portion has a high rigidity. A weight material is mounted near a central part of the sole portion in the fore-to-aft direction, and a rib extends in the toe-to-heel direction. Since the sole portion has high rigidity in the toe-to-heel direction, there is less deformation of the head in the toe-to-heel direction when hitting the ball, thereby suppressing the vibration of the sole portion. An elastic body is filled in a recess portion and closely contacted with the weight material, whereby the vibration of the sole portion is absorbed by the elastic body.

22 Claims, 5 Drawing Sheets

GOLF CLUB HEAD

BACKGROUND OF THE INVENTION

1. Field of the Invention

The present invention relates to a hollow golf club head, and particularly to a golf club head being of a wood type or similar type thereto.

2. Description of the Related Art

As wood-type golf club heads such as drivers and fairway woods, metallic heads of a hollow shell structure are widely in use. Generally, the hollow wood-type golf club head has a face portion for hitting a ball, a crown portion constituting an upper surface portion of the golf club head, a sole portion constituting a bottom surface portion of the golf club head, a side portion constituting side surface portions on the tow side, the rear side, and the heel side of the golf club head, and a hosel portion. A shaft is inserted into the hosel portion, and is fixed by an adhesive agent or the like. It should be noted that golf clubs called utility clubs are also commercially available on the market in large numbers, and various golf clubs having a head similar to the aforementioned wood-type golf club head (i.e., having the face portion, the sole portion, the side portion, the crown portion, and the hosel portion) are also commercially available on the market.

As metals for forming this hollow golf club head, an aluminum alloy, stainless steel, and a titanium alloy are used. The titanium alloy, in particular, has come to be used widely in recent years (refer to JP-A-2003-88601).

Generally, it becomes possible to enlarge the sweet spot by increasing the volume of the hollow golf club head. If the volume is increased, the weight of the golf club head tens to increase correspondingly. Accordingly, to prevent an increase in the weight, a thickness of a shell portion of the golf club head has been made thin.

To have a center of gravity of the golf club head at lower position, a weight member has been mounted on the sole portion.

SUMMARY OF THE INVENTION

In recent years, the drivers having a larger size of 300 c or beyond are available on the market. When the size is increased, the head is made thinner to suppress the increased weight, but there is a fear that the rigidity is partially insufficient due to smaller thickness. Particularly, since the sole portion of flat shape is decreased in rigidity, the amplitude of vibration produced at the time of shot is prone to increase.

It is an object of the invention to provide a golf club head in which the sole portion has a high rigidity.

According to an aspect of the invention, there is provided a golf club head having a hollow shell structure, including a face portion; a sole portion; and a rib provided on the sole portion, wherein at least the face portion and the sole portion are made of metallic.

Preferably, the rib extends in a toe-to-heel direction.

Preferably, the rib extends in a fore-to-aft direction.

Preferably, the rib extends in a direction between the toe-to-heel direction and the fore-to-aft direction.

Preferably, the rib extends in a plurality of directions.

The golf club head preferably includes a weight material mounted in the sole portion, wherein the rib extends from a position on which the weight material is mounted.

The golf club head preferably includes a recess portion provided on the sole portion which is depressed inward, and an elastic body, wherein the weight material is mounted by a screw into the recess portion, and the elastic body is filled in a closed space surrounded by an upper end face of the weight material and a rearmost part of the recess portion.

Preferably, a volume of the golf club head is configured to be in a range of 250 to 600 cc.

In the golf club head according to the invention, the rib is provided in the sole portion, whereby the rigidity of the sole portion is high, and the amplitude of vibration produced in the sole portion at the time of shot is smaller.

In a case where the rib extends in a toe-to-heel direction (direction connecting the toe side and the heel side), the rigidity in the toe-to-heel direction is high. In a case where the sole portion is provided with no rib in the fore-to-aft direction (direction orthogonal to the face plane), the head is likely flexed in the fore-to-aft direction. Therefore, it is possible to increase the carry of the ball, employing the deflection in the fore-to-aft direction.

In a case where the rib extends in a fore-to-aft direction, the deflection of the sole portion at the time of shot is reduced, and the deflection of the crown portion is increased. Therefore, the batting angle of ball is increased.

In a case where the weight material is provided, especially in the almost central part of the sole portion, the sole portion is prone to vibrate around the weight material when hitting the ball. Thus, the rib is preferably provided to extend from the weight material installed position in the toe-to-heel direction to suppress the vibration.

In a case where an elastic body is filled in a closed space surrounded by a rearmost portion of the recess portion, into which the weight material is screwed, and the weight material, the vibration of the weight material is absorbed.

The invention is suitably applied to the large golf club head having a wide sole area in which the volume of the golf club head is 250 or more, for example, from 250 to 600 cc.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

Figure 1:
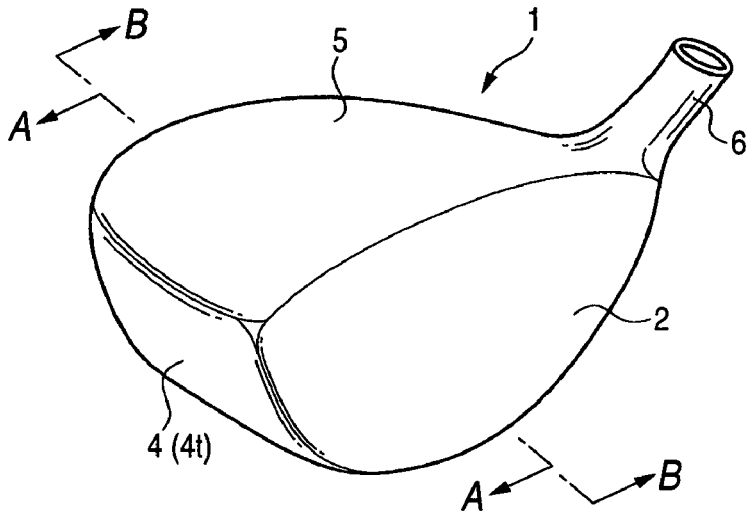
FIG. 1 is a perspective view of a golf club head according to an embodiment of the invention.
Figure 2A:
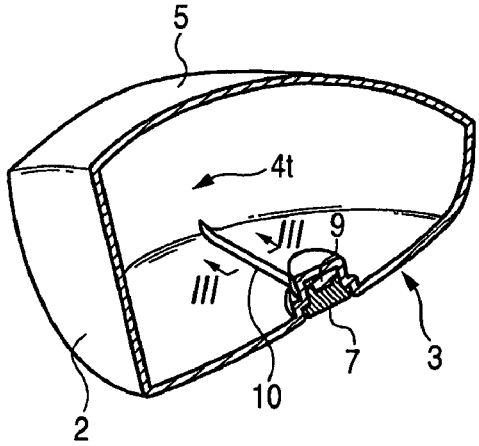
FIG. 2A-B are perspective views, in cross section, of the golf club head as shown in FIG. 1.
Figure 2B:
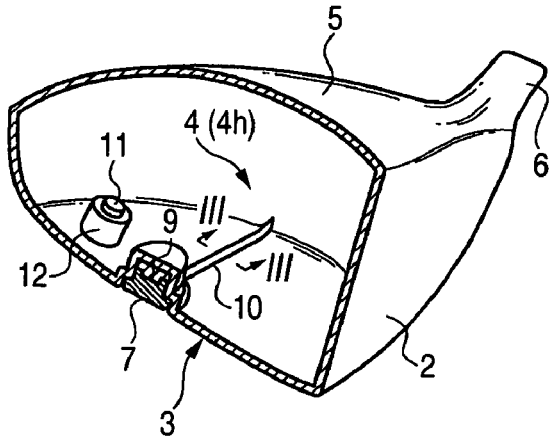
Figure 3:
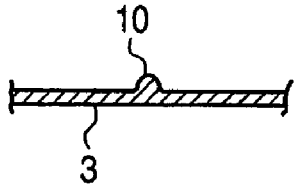
FIG. 3 is a cross-sectional view of the golf club head taken along the line III-III as shown in FIG. 2.
Figure 4:
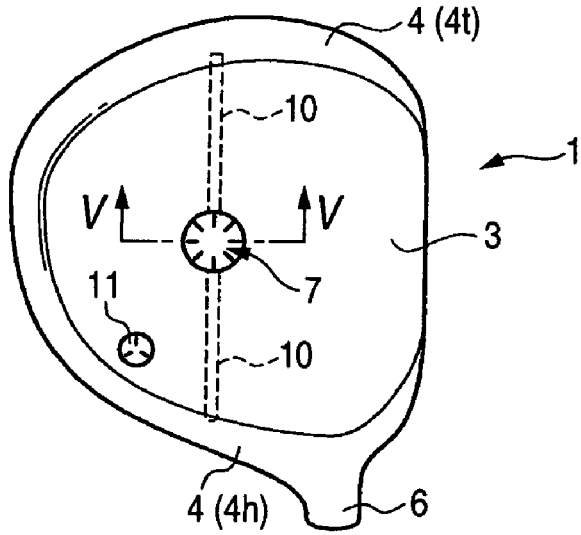
FIG. 4 is a bottom view of the golf club head.
Figure 5:
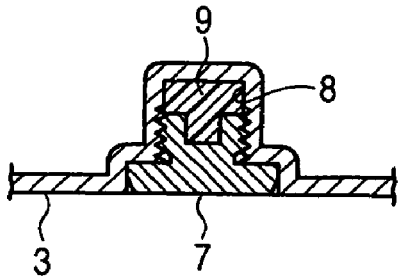
FIG. 5 is a cross-sectional view of the golf club head taken along the line V-V as shown in FIG. 4.
Figure 6:
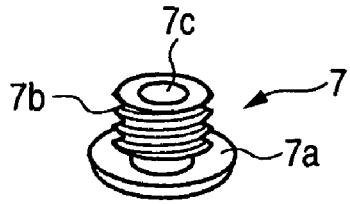
FIG. 6 is a perspective view of a weight material.

The preferred embodiments of the present invention will be described below with reference to the accompanying drawings. FIG. 1 is a perspective view of a golf club head according to an embodiment of the invention. FIGS. 2A and 2B are perspective views, in cross section, of the golf club head taken along the line A-A and the line B-B as shown in FIG. 1. FIG. 3 is a cross-sectional view of the golf club head taken along the line III-III as shown in FIG. 2. FIG. 4 is a bottom view of the golf club head. FIG. 5 is a cross-sectional view of the golf club head taken along the line V-V as shown in FIG. 4. And FIG. 6 is a perspective view of a weight material.

This golf club head 1 is of wood type and has a hollow shell structure including a face portion 2, a sole portion 3, a side portion 4, a crown portion 5 and a hosel portion 6.

The face portion 2 is a plane for hitting the ball, and provided with grooves (score lines), not shown. The sole portion 3 makes up a bottom face portion of the golf club head, and the side portion 4 makes up a side face portion on the toe side, the heel side and the rear side. The crown portion 5 makes up an upper face portion of the golf club head. A shaft is inserted into the hosel portion 6, and fixed by adhesives.

This golf club head 1 is made of titanium metal material (titanium alloy or pure titanium).

The thickness of the sole portion (excluding the rib) is from 0.8 to 1.2 mm, especially from 0.8 to 11.0 mm.

A weight material 7 made of a high specific gravity material such as tungsten or tungsten alloy is mounted near the central part of the sole portion 3 in the fore-to-aft direction, and a rib 10 extends in the toe-to-heel direction. A recess portion 8 having almost cylindrical shape, into which the weight material 7 is screwed, is provided near the center of the sole portion 3 in the fore-to-aft direction and the toe-to-heel direction. This recess portion 8 is like a counterbore with an upper face sealed. As shown in FIG. 5, a step portion is provided at the entrance of this recess portion 8. An internal thread is provided on an inner circumferential face at the back of the step portion.

The weight material 7 is in the form of a bolt having a flange 7*a* and a thread portion 7*b*, which is engaged with the internal thread in the recess portion 8, as shown in FIG. 6. A small counterbore 7*c* is provided at a top end face (upper end face) of this weight material 7.

After an elastic body 9 made of rubber or synthetic resin is filled in a rearmost part of the recess portion 8, the weight material 7 is screwed into the recess portion 8. The weight material 7 is tightly screwed until the flange 7*a* contacts the step portion at the entrance. Thereby, the weight material 7 is fixed to the sole portion 3, and the elastic body 9 is intimately contacted with the overall inner face of the closed space between the rearmost part of the recess portion 8 and the top end face of the weight material 7. The elastic body 9 enters the small counterbore 7*c* of the weight material 7, and is intimately contacted with the inner face of the small counterbore 7*c*.

Figure 8A:
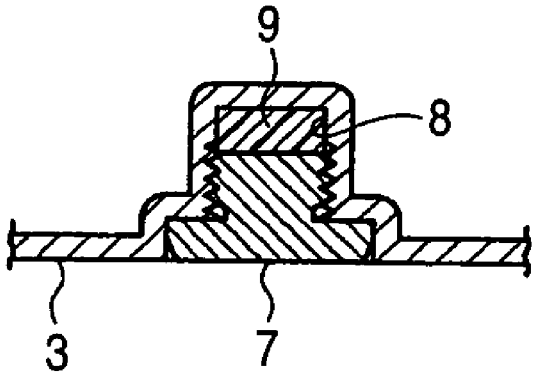
FIG. 8A is a cross-sectional view of a weight material according to another embodiment of the invention.
Figure 8B:
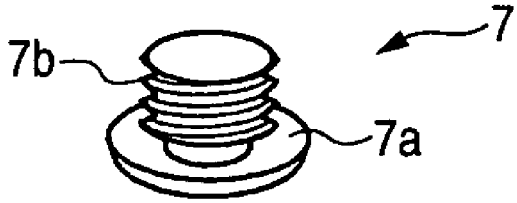
FIG. 8B is a perspective view of the weight material shown in FIG. 8A

As shown in FIG. 8B, the weight material 7 can be made without the counterbore 7*c*. In this case, since the elastic body 9 presses against a top surface of the weight material 7, the screw portion 7*b* of the weight material 7 is tightly engaged and becomes hard to loosen, as shown in FIG. 8A.

Figure 8C:
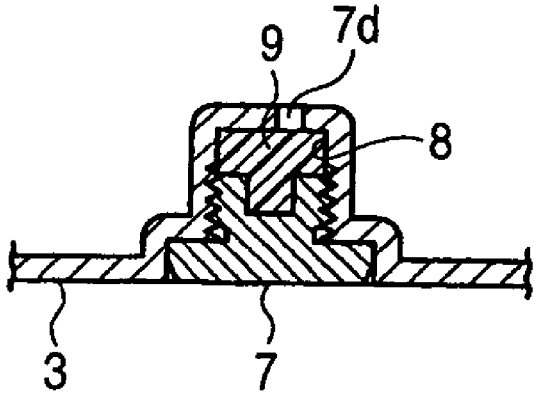
FIG. 8C is a cross-sectional view of a weight material according to another embodiment of the invention.

Additionally, the recess portion 8 can be provided with a de-aeration bore 7*d* as shown in FIG. 8C. By this configuration, air between the elastic body 9 and the rearmost part of the recess portion 8 can be let out through the de-aeration bore 7*d*, so that the coherence degree of elastic body 9 and recess portion 8 rises.

On the inner face of the sole portion 3, the rib 10 is provided to lead to the recess portion 8 and further extend in the toe direction and the heel direction. This rib 10 extends from the side portion 4*t* on the toe side to the side portion 4*h* on the heel side. The height of the rib 10 is from 1.2 to 5.0 mm, especially from about 1.5 to 2.5 mm, and the width (width in the direction orthogonal to the extending direction) is from 1.0 to 8.0 mm, especially from about 1.0 to 3.0 mm.

In this embodiment, another weight material 11 is attached on the rear part of the sole portion 3 and somewhat on the heel side. This weight material 11 is screwed in a boss portion 12 of cylindrical shape protruded inwardly from the sole portion 3.

In the golf club head 1 constituted in this manner, the sole portion 3 is provided with the rib 10, whereby the rigidity of the sole portion 3 in the toe-to-heel direction is high, the deformation in the toe-to-heel direction is suppressed at the time of hitting the ball, the vibration of the sole portion 3 is suppressed, and the amplitude is reduced. Particularly, the weight material 7 is disposed in the extending direction of the rib 10, whereby the vibration around the weight material 7 is fully suppressed.

In this embodiment, since the rib 10 is not provided in the fore-to-aft direction, the sole portion 3 is prone to flex in the fore-to-aft direction at the time of hitting the ball, whereby it is possible to increase the flying distance of the ball.

In this embodiment, since the elastic body 9 is filled in the recess portion 8 to be intimately contacted with the weight material 7, the vibration of the sole portion 3 is absorbed by this elastic body 9. This elastic body 9 acts to prevent looseness of the weight material 7.

Figure 7A:
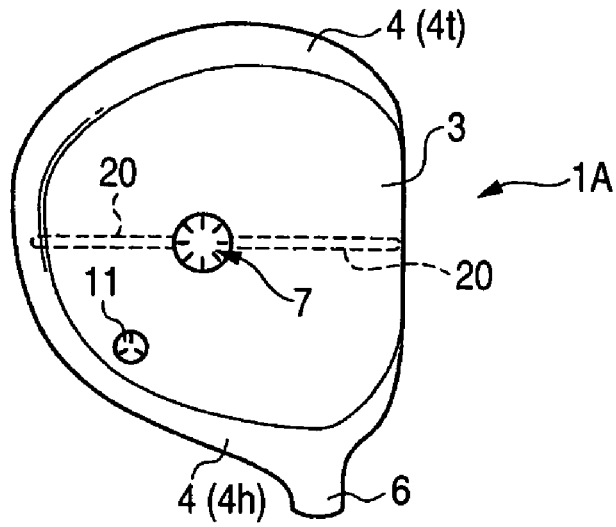
FIG. 7A-C are bottom views of a golf club head according to another embodiment of the invention.
Figure 7B:
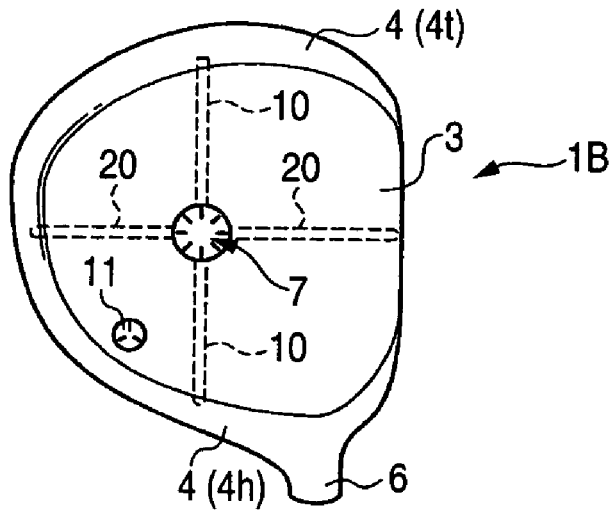
Figure 7C:
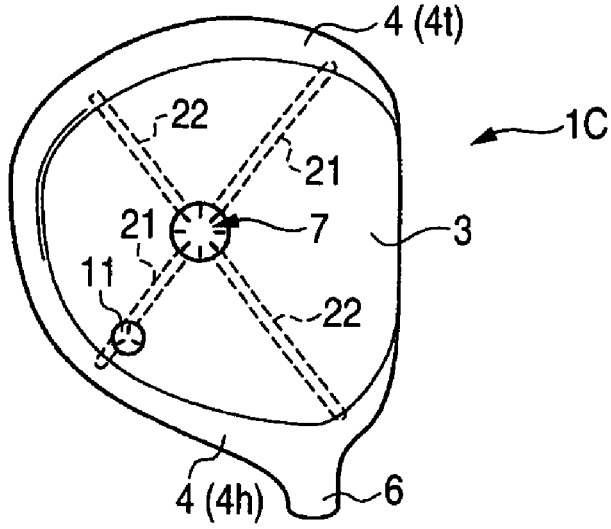

Referring to FIG. 7, another embodiment of the invention will be described below. FIGS. 7A, 7B and 7C are bottom views of the golf club head according to this embodiment.

In the golf club head 1A of FIG. 7A, a rib 20 is provided in the fore-to-aft direction. In the golf club head 1B of FIG. 7B, two-way ribs, including the rib 20 in the fore-to-aft direction and the rib 10 in the toe-to-heel direction, are provided. In the golf club head 1C of FIG. 7C, two-way ribs 21 and 22 extending in the direction (extending obliquely at an angle of about 40 to 60° to the fore-to-aft direction in this embodiment) between the fore-to-aft direction and the toe-to-heel direction are provided. These ribs 20, 21 and 22, like the rib 10, extend from the weight material 7. The rib 20 extends from the face portion 2 to the side portion on the back side. The ribs 21 and 22 extend from the side portion 4*t* on the toe side to the side portion 4*h* on the heel side. The rib 21 is provided so that its extension line may traverse the weight material 11.

In these golf club heads 1A, 1B and 1C, the rigidity of the sole portion 3 in the fore-to-aft direction is high. Therefore, the amplitude of the sole portion when hitting the ball is suppressed, and deflection of the sole portion 3 in the fore-to-aft direction is reduced. In this way, since the deflection of the sole portion 3 is reduced, the deflection of the crown portion 5 is increased, whereby the batting angle of the ball is increased so that the ball is likely to rise.

In the above embodiments, the overall golf club head is made of metal, but may be made of FRP in a part (e.g., crown portion, or crown portion and side portion).

Figure 9A:
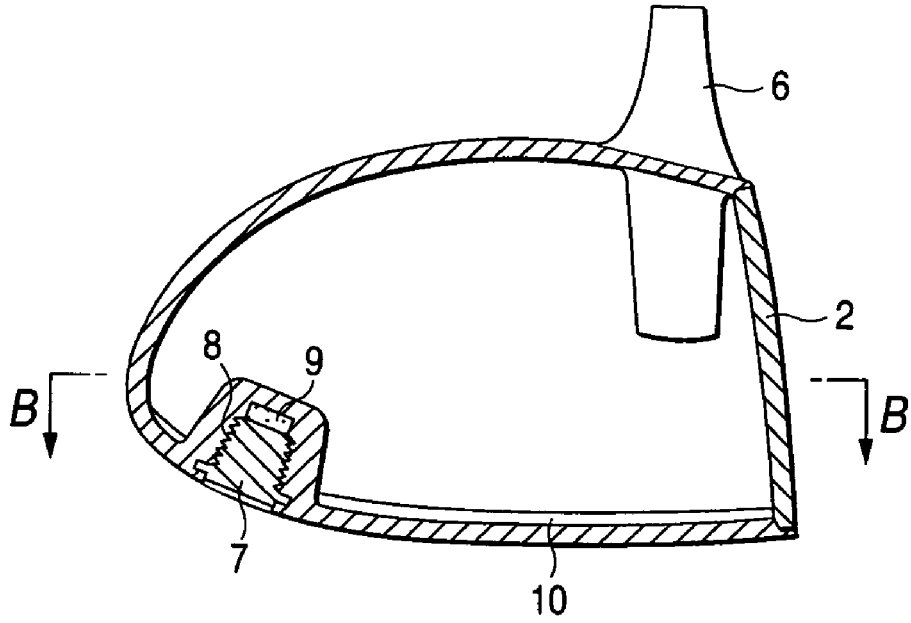
FIG. 9A is a cross-sectional view of a golf club head according to another embodiment of the invention and FIG. 9B is a cross-sectional view of the golf club head taken along the line B-B as shown in FIG. 9A.
Figure 9B:
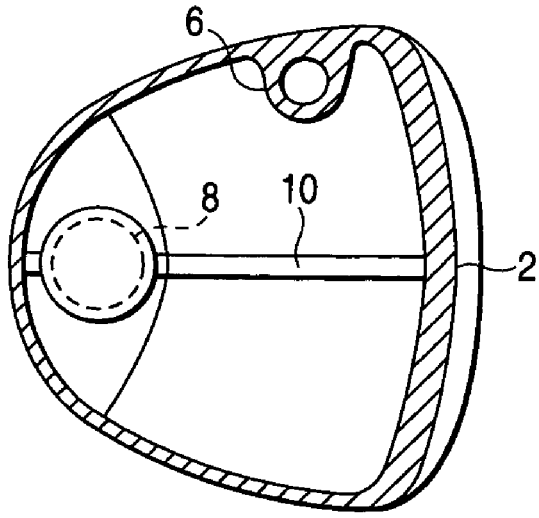

In addition, the rearward part of the sole portion 3 can be provided with an upward incline thereof, and the weight material 7 on the incline portion as shown in FIG. 9A. Since the incline portion does not hit the ground when hitting a ball, a plate made of aluminum or plastic with a logo and so on can be attached over the weight material 7 by an adhesive agent or the like to conceal the weight material 7.

It is possible to apply this configuration to the weight material 11, so that the weight material may be provided on the incline portion.

For example, the golf club head according to the embodiment is manufactured by molding at least one of the face portion and the crown portion separately from the sole portion, and then weld them together.

Basically, the face portion, the hosel portion and the crown portion are integrally formed by molding, and the sole portion is formed by casting. Then, these two members are welded. It is also possible to produce the golf club head by welding the following two members; the face portion and the crown portion formed from a plate material by a press forming, and the sole portion and the side portion are integrally formed by casting. Then, these two members are welded.

In this invention, a thickened portion may be provided in a shell portion on the toe side, the heel side or the back side to enlarge a sweet area on the face plane.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A golf club head having a hollow shell structure, comprising:

a face portion;

a sole portion;

a rib provided on the sole portion; and a weight material mounted to the sole portion, wherein at least the face portion and the sole portion are made of metal, and the rib extends from a position on which the weight material is mounted such that an extension line of the rib traverses the weight material, wherein the golf club head further comprises a recess portion provided on the sole portion which is depressed inward, and an elastic body, wherein the weight material is mounted by a screw into the recess portion, and the elastic body is filled in a closed space surrounded by an upper end face of the weight material and a rearmost part of the recess portion.

2. The golf club head according to claim 1, wherein the rib extends in a toe-to-heel direction.

3. The golf club head according to claim 1, wherein the rib extends in a fore-to-aft direction.

4. The golf club head according to claim 1, wherein the rib extends in a direction between a toe-to-heel direction and a fore-to-aft direction.

5. The golf club head according to claim 1, wherein the rib extends in a plurality of directions.

6. The golf club head according to claim 1, wherein a volume of the golf club head is configured to be in a range of 250 to 600 cc.

7. The golf club head according to claim 1, further comprising a second weight material provided on the sole portion, wherein the second weight material is provided on a position where a extension line of the rib traverses.

8. The golf club head according to claim 1, wherein the rib provided on the sole portion has a height of 1.2 mm to 5.0 mm.

9. The golf club head according to claim 1, wherein the rib provided on the sole portion has a width of 1.0 to 8.0 mm, the width being measured in a direction orthogonal to a direction in which the rib extends from the position on which the weight material is mounted.

10. A golf club head having a hollow shell structure, comprising:

a face portion;

a sole portion;

a rib provided on the sole portion;

a recess portion provided on the sole portion which is depressed inward;

a first weight material; and an elastic body, wherein the rib extends from a position on which the recess portion is provided, and the first weight material is mounted in the recess portion, and the elastic body is filled in a closed space surrounded by an upper end face of the first weight material and a rearmost part of the recess portion.

11. The golf club head according to claim 10, wherein the rib extends in a toe-to-heel direction.

12. The golf club head according to claim 10, wherein the rib extends in a fore-to-aft direction.

13. The golf club head according to claim 10, wherein the rib extends in a direction between a toe-to-heel direction and a fore-to-aft direction.

14. The golf club head according to claim 10, wherein the rib extends in a plurality of directions.

15. The golf club head according to claim 10, further comprising a second weight material provided on the sole portion, wherein the second weight material is provided on a position where a extension line of the rib traverses.

16. The golf club head according to claim 10, wherein the sole portion includes an incline portion, and the recess portion is provided on the incline portion.

17. The golf club head according to claim 16, wherein the recess portion is covered with a plate so as to conceal the first weight material.

18. The golf club head according to claim 10, wherein the rib provided on the sole portion has a width of 1.0 to 8.0 mm, the width being measured in a direction orthogonal to a direction in which the rib extends from the position on which the weight material is mounted.

19. The golf club head according to claim 10, wherein the rib extends from the position on which the weight material is mounted such that an extension line of the rib traverses the weight material.

20. The golf club head according to claim 10, wherein the rib provided on the sole portion has a height of 1.2 mm to 5.0 mm.

21. A golf club head having a hollow shell structure, comprising:

a face portion;

a sole portion; and a rib provided on the sole portion, wherein at least the face portion and the sole portion are made of metal, wherein the golf club head further comprises:

a weight material mounted in the sole portion, wherein the rib extends from a position on which the weight material is mounted, a recess portion provided on the sole portion which is depressed inward, and an elastic body, wherein the weight material is mounted by a screw into the recess portion, and the elastic body is filled in a closed space surrounded by an upper end face of the weight material and a rearmost part of the recess portion.

22. A golf club head according to claim 21, further comprising an elastic body.

* * * * *